United States Patent [19]

Hoyt et al.

[11] 4,026,083

[45] May 31, 1977

[54] BRICKWORK FORM

[75] Inventors: Peter B. Hoyt, Great Falls, Va.; Stephen V. C. Schuyler, Bethesda, Md.

[73] Assignee: Betco Block & Products, Inc., Bethesda, Md.

[22] Filed: Apr. 29, 1976

[21] Appl. No.: 681,681

[52] U.S. Cl. ..... 52/387; 428/49; 156/71

[51] Int. Cl.[2] ..... E04F 13/08; E04B 2/28

[58] Field of Search ..... 52/384–392, 52/311–316, 318, 474–477; 156/71; 428/48–51

[56] References Cited

UNITED STATES PATENTS

| | | | |
|---|---|---|---|
| 636,200 | 10/1899 | Frink | 52/386 |
| 903,183 | 11/1908 | Eggers | 52/387 |
| 1,861,359 | 5/1932 | Pyron | 52/387 |
| 1,932,274 | 10/1933 | Kublanow | 52/385 |
| 2,114,710 | 4/1938 | Holcomb | 52/387 |
| 2,852,932 | 9/1958 | Cable | 52/385 |
| 3,025,772 | 3/1962 | Palatini | 52/318 |
| 3,238,682 | 3/1966 | Tracy et al. | 52/387 |
| 3,521,418 | 7/1970 | Bartoloni | 52/315 |
| 3,533,206 | 10/1970 | Passeno | 156/71 |

FOREIGN PATENTS OR APPLICATIONS

| | | | |
|---|---|---|---|
| 1,185,268 | 2/1959 | France | 428/49 |
| 1,212,833 | 11/1970 | United Kingdom | 52/387 |

*Primary Examiner*—James L. Ridgill, Jr.

[57] ABSTRACT

A modular form is disclosed for enabling an individual unskilled in bricklaying techniques to install professional looking patios, walkways, or to resurface walls and the like. The forms comprise tray-like modules, containing a network of grids which create brick-shaped voids arranged in commonly used brick patterns. After placing the modules on a suitable surface, bricks are inserted into the voids and a suitable grouting material such as sand and portland cement or masonry cement is applied between the bricks. The modules insure correct brick pattern spacing and a professional looking final product and permit considerable time savings when compared to conventional methods. The grids are preferably arranged to form a "basket-weave" pattern for ground use and a "running bond" pattern for wall use, but other patterns are also disclosed. The invention also provides interlocking means for the modules so that uniformity of the pattern is retained in the creation of various sized patios, walkways or brick walls.

10 Claims, 5 Drawing Figures

BRICKWORK FORM

BACKGROUND OF THE INVENTION

The present invention relates generally to the art of bricklaying and in particular to a modular form which will enable a homeowner or other individual unskilled in bricklaying techniques to produce a professional looking patio, walkway or resurfaced wall at a cost substantially below that which would be incurred if professional bricklayers were hired to do the same project and in substantially less time than that required without the use of such modular forms.

Homeowners and other do-it yourself enthusiasts are reluctant to attempt construction projects involving the laying of bricks or patio blocks because it is difficult for one unskilled in such arts to produce a final product having a consistently correct pattern, even brickwork spacing and a good appearance. If such people want a brick patio or walkway, they commonly seek to employ professional bricklayers to do the job. The cost for such projects may then become prohibitive as the labor costs for such work often exceeds the cost of materials. Alternatively, due to the excessive time required to create a pattern, such people may lay the brick without attempting a pattern, e.g. end to end or side to side. These problems are especially pronounced if the patio or walkway desired is to be of a "fancy" pattern such as basketweave or herringbone.

While it is known in the construction industry that brick forms may be employed for preparing precast walls and roadways, there are, to the present inventor's knowledge, no products on the market which permit the do-it-yourselfer to prepare patios and walkways or to resurface a wall with brick to yield a professional looking appearance at nominal cost. Such a product must be adaptable for projects of different size. Such a product would enable many people, who previously would have been unable to afford it or would have been reluctant to attempt a fancy pattern, the opportunity to add professional looking brickwork improvements to their homes and yards.

OBJECTS OF THE INVENTION

A primary object of the present invention is to provide a modular form to allow one unskilled in bricklaying arts to construct patios or to resurface walls and the like, and have the final product be professional looking in appearance.

Another object of the present invention is to provide such forms which will permit the final product to contain a fancy brickwork pattern, for example, basketweave.

Another object of the present invention is to save the do-it-yourself enthusiast time in creating brick patterns in patio or walkway construction or in wall resurfacing.

A further object of the present invention is to provide such forms with interlocking means to enable a plurality of the same modular units to be adapted for patio or walkway construction or wall resurfacing in order to retain a uniform pattern, no matter what the size or shape.

A still further object of the present invention is to provide walkway or patio bricklaying forms which have drainage and vegetation growth retarding capabilities. Another object of the present is to provide such modules which are lightweight and inexpensive to manufacture and yet provide increased rigidity when used on a sand or earthen base to produce a more level surface plane.

Yet another object of the present invention is to provide modular forms which may be employed for laying brickwork on either horizontal or vertical surfaces.

How these and other objects of the invention are accomplished will be described in the following specification, taken in conjunction with the drawings. Generally, however, the invention comprises a tray-like bricklaying module containing brickshaped voids defined by a grid network. The voids have a depth and the grids have a height which is substantially less than the thickness of standard brick or patio blocks. The modules also contain apertures within the brick-shaped sections for drainage (if the modules are used for walkways or patios) or for cementing brick splits to a vertical surface (if the modules are used for resurfacing walls and the like). Each module also contains interlocking means to permit a plurality of the units to be joined together in the shape of a patio, walkway or wall to insure uniformity of patterns. After the modules are applied to a properly prepared surface, the bricks are inserted into the voids and a suitable grouting material such as masonry cement or a dry cement and sand mixture is applied above the grids and between the bricks to complete the project.

DESCRIPTION OF THE PREFERRED EMBODIMENT

Figure 1:
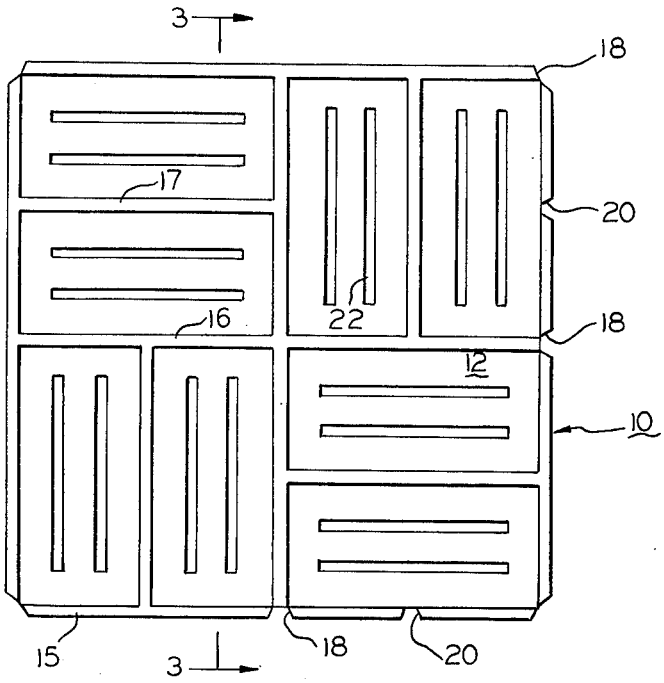
FIG. 1 is a top view of a single bricklaying module according to one preferred form of the present invention.

It should be understood at the outset that only two embodiments of the present invention are shown in the drawings and that various modifications of the concepts of the present invention can be made by one skilled in the art. For example. the drawings show a modular form 10 containing eight voids 12 sized to hold modular construction bricks 14, but the principles of the invention could easily be adapted for other size modules and the spaces could be sized for patio block, concrete block, modular brick or other such similar construction blocks. Also, while the illustrated embodiments are designed for laying bricks in basketweave or running bond patterns, other patterns can be employed. The FIGURES can best be understood when viewed in combination.

The modules 10 are preferably vacuum formed from a thin sheet 11 of plastic, molded to define voids 12. An outer rim 15 and grids 16 and 17 define the voids. Grids 16 divide module 10 into four equal and substantially square voids while grids 17 divide each of these latter voids into two brick shaped voids 12. In the preferred form of the invention, the rim 15 and grids 16 and 17 have a thickness of ⅜ inch and the voids 12 have a size of 3½ × 7⅝ inches the size of modular construction brick. Furthermore, the rim 15 and grids 16 and 17 have a height of approximately ½ inch. Other weather resistant materials, such as treated papers or metal foils, could be used to form module 10, but for reasons to be discussed shortly, plastics are preferred. To illustrate at this point how the modules 10 can be adapted to other construction materials, the voids can measure 8 × 3½ inches inches if standard bricks are to be laid on a horizontal surface. For wall resurfacing modules, the grid dimensions will be 8 inches (or 7⅝ inch) ×2174 inches and the grid and rim height will be reduced to ⅜ inch or less, all as will be understood when the rest of this specification is read.

Figure 2:
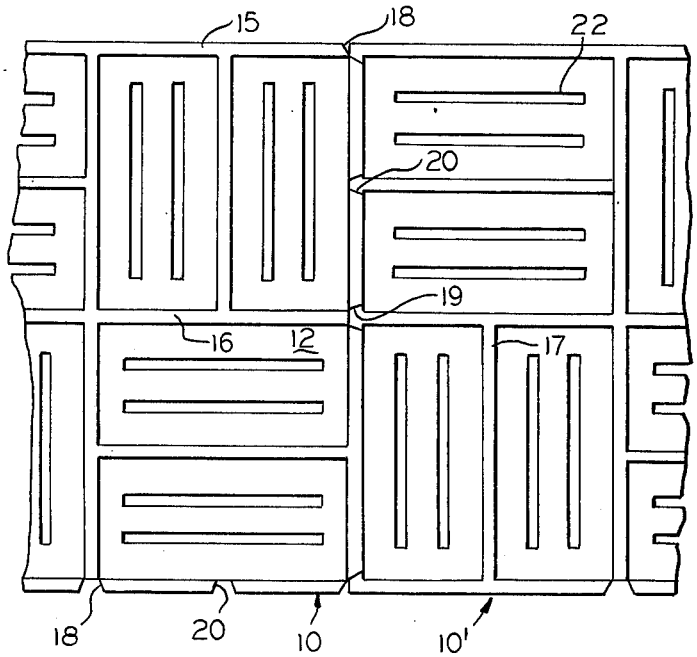
FIG. 2 is a top view, with parts removed, showing two of the modules of FIG. 1 interconnected.
Figure 3:
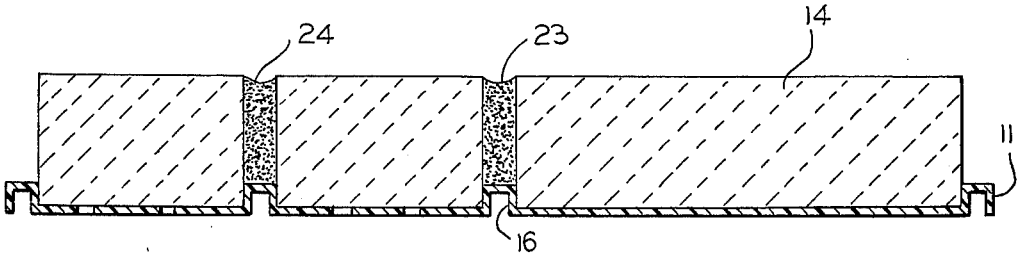
FIG. 3 is a cross-section taken along the line 3—3 of FIG. 1 showing bricks and grouting material added to the module in an embodiment when the module is used for laying brick on a horizontal surface.

FIG. 1 also shows that module 10 includes eight cut-outs in rim 15. These cut-outs are provided for interlocking a plurality of modules 10 together, and their method of operation can best be understood by reference to FIG. 2. This latter FIGURE shows two modules 10 and 10' joined according to the principles of the present invention. Module 10 is shown (with a portion removed) as in FIG. 1 while Module 10' is identical. It will be obvious after reading the entire specification that the modules need contain the cut-outs only on two contiguous sides to complete the interlocking. However, modules 10 may include cut-outs on all four sides, or two different modules may be employed, one having cut-outs on all four sides and the other not having cut-outs.

The cut-outs include a cut out 18 at each corner of module 10 as well as cut-outs for the grids. For the basketweave module 10, a cut-out 19 is provided at the midpoint of two contiguous sides of rim 15 and two additional cut-outs 20 are included for grids 17 on the same contiguous sides. Additional modules 10 and 10' can be added to the two modules shown in FIG. 2 in a similar manner. The illustrated shape of cut-outs 18–20 is for purposes of illustration only as other shapes which accomplish the desired overlapping of rim 15 can also be employed.

Another feature of modules 10 and 10' are slots 22 formed in each of the brick-shaped voids 12. The slots 22 are provided for a variety of purposes depending on the use of modules 10 and 10'. If the modules are used for laying a patio or brick walkway, slots 22 serve as drainage aids, while if the modules are employed for vertical work, such as resurfacing a wall, the slots 22 serve to expose cementous material in order to adhere brick splits to the surface. Examples of how modules 10 and 10' are used for each of these kinds of jobs will now be provided. Holes, in a variety of numbers or shapes, can be employed in lieu of slots 22.

Dealing first with the use of the modules according to the present invention for forming patios, brick walkways and the like, the installer first lays out the outer dimensions on a suitable level surface which may be asphalt, concrete, level sand or level earth. An exterior or boundary frame must be used except in cases where the top surface plane is intended to be ground level, in which case earthen walls will suffice. Modules 10 and 10' are then laid on the surface and interlocked as described above. To illustrate, if module 10 has dimensions of 16⅜'' × 16⅜'' (for modular bricks) and it is desired to prepare a rectangular patio measuring approximately 20' × 12', 135 of the modules are laid on the surface, 15 in one direction and nine in the other. If a walkway, 24' × 2'8'' is desired, 36 of the modules are employed, 18 long and two wide.

After the modules are in place, bricks 14 are inserted in each of the sections 12. To complete the project, mixed masonry cement and sand or a dry cement-sand mixture 23 is added above the grids 16 and 17 and between bricks 14. A finishing tool can be employed to provide the concave surface 24 to the mixed masonry cement or a flush joint can be obtained by spraying the dry grouted brickwork with a fine water mist.

It should be pointed out here that modules 10 and 10' remain in place after completion of the project and provide the important advantage of retarding vegetation growth between bricks 14 and providing rigidity to insure a uniform top surface plane.

Figure 4:
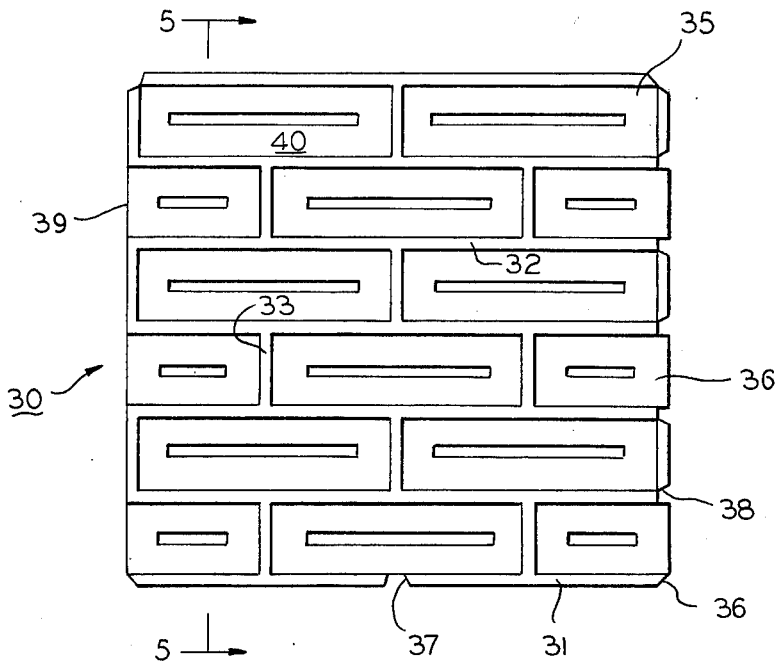
FIG. 4 is a top view of a running bond pattern module useful for resurfacing a wall with brick.
Figure 5:
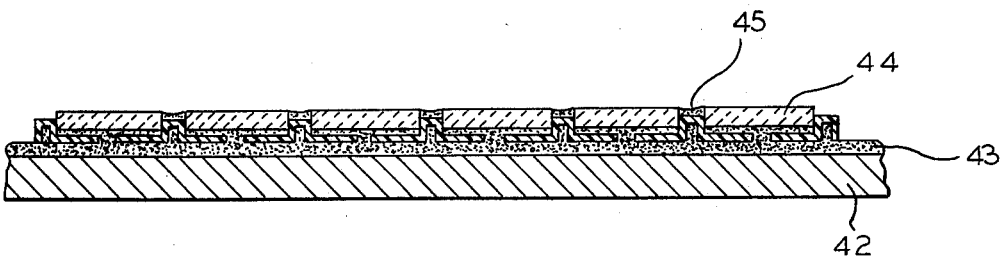
FIG. 5 is a cross-section taken along the line 5—5 of FIG. 4 showing brick splits and grouting material added to the module of FIG. 4.

Dealing next with the use of the modules of the present invention for wall resurfacing, reference should be had to FIGS. 4 and 5. These FIGURES show a module 30 designed for applying a running bond pattern and in many respects module 30 resembles module 10, previously discussed. Here, however, rim 31 and grids 32 and 33 are arranged to define nine full size brick voids 35 and six half-length brick voids 36.

In the running bond pattern the bricks are arranged in rows with adjoining rows off-set by one-half brick length and the rows are separated by parallel mortar joint. These joints are defined by rim 31 and grids 32. The joints between the ends of the bricks are defined by grids 33.

In the illustrated embodiment of FIG. 4, the module has overall dimensions of 16⅜ × 16⅛ inches and is designed for use with modular brick splits measuring 7⅝ × 2¼ ×½ inches. The height of the grids and rim is apparently ⅜ inches in this embodiment.

Cut-outs 36 are again provided at the corners of module 30 and additional cut-outs are provided for the grid work. In this embodiment the rim 31 includes a cut-out 37 on one side for overlapping a grid 33 of another module and five cut-outs 38 on a contiguous perpendicular side to overlap rim 31. Rim 31 also includes six large cut-outs 39, three on each end, to permit a single brick split to overlap two modules. Slots 40 are also provided in each void.

To use modules 30, a wall 42 is covered with a layer of adhesive material 43 and modules 30 are pressed into the adhesive. In doing so some of the adhesive 43 will be forced through the slots 40. Brick splits 44 are then pressed into the voids 35 and 36 and are held in place, both by the adhesive 43 below the splits and a suitable grouting material 45 applied by the installer after the splits are in place. A caulking gun or the like can be used to apply the grouting material 45.

The thin plastic 11 used for modules 10 is preferred because it can be cut with a pair of scissors to permit adaptation to irregular shaped areas. In addition, the material is lightweight and easy to package while still being somewhat rigid.

Another feature of the present invention comprises forming modules 10 or 30 in such a manner that the rims 15 and 31 respectively are slightly wider on the edges containing cut-outs than those on the cut-out free edges. In this way the modules can be more easily interconnected and the visual difference in width of two of the sides compared to the other two sides permits easier layout of the modules by a novice and assures proper orientation of the modules on the surface to be covered.

As mentioned earlier, other patterns can be employed, such as herringbone. For such patterns, entire sections of the rim 15 would be cut out to permit whole bricks to overlap two or more modules.

In summary, the present invention incorporates principles which may be variously embodied to permit homeowners to produce professional looking brickwork surfaces, and while the invention has been described in connection with two preferred embodiments, the invention is not to be limited thereby, but is to be limited solely by the claims which follow.

We claim:

1. A modular form for laying blocks in a desired pattern comprising:

a. a sheet of semi-rigid material including a raised peripheral rim and a plurality of dividers, said rim including two pairs or opposed parallel sides and square corners, said rim and said dividers being generally U shaped in cross-section and each being of substantially the same height, said height being less than the height of the blocks to be laid, b. a plurality of block-shaped sections formed on said sheet by said rim and said dividers, said sections being arranged in said desired pattern, and c. means on the rim of said sheet for permitting interlocking of a plurality of said forms to one another and for permitting continuation of said desired pattern between adjoining forms.

2. The invention set forth in claim 1 further including rectangular blocks disposed in each of said sections, said blocks being higher than said rim and dividers and grouting material between said blocks.

3. The invention set forth in claim 1 wherein the width of the rim on two contiguous sides of said form is less than the width of said dividers and the width of the rim of said other two sides.

4. The invention set forth in claim 1 wherein said form has at least one aperture within each of said sections.

5. The invention set forth in claim 4 further including rectangular blocks disposed in each of said sections, said blocks being higher than said rim and dividers and grouting material intermediate said sheet and the adjoining surface of said blocks and grouting material between said blocks.

6. The invention set forth in claim 1 wherein said interlocking means comprise cut-out portions of said rim means ro permit the rim of one unit to overlap the rim of an adjoining unit.

7. The invention set forth in claim 6 wherein said pattern is a running bond pattern and wherein said interlocking means additionally includes cut-out portions of said rim means to accomodate said dividing means and block overlap between adjoining forms.

8. The invention set forth in claim 6 wherein said pattern is a basketweave pattern and said dividers define at least eight rectangular block shaped sections on said sheet the major lengths of at least four of said sections being in a direction perpendicular to the major length of the remaining sections and wherein said interlocking means includes additional cut-out portions of said rim means to accomodate said dividing means.

9. The invention set forth in claim 8 wherein said form is substantially square and wherein said dividers comprise:

two dividers joining the mid-points of opposing sides of said square to divide said square into four smaller squares, and four additional dividers, one located in each of said smaller squares and joining the mid-point of one set of opposing sides thereof, the direction of two of said additional dividers being perpendicular to the direction of the remaining two additional dividers.

10. The invention of claim 9 wherein the direction of two of said additional dividers is the same for diagonal ones of said smaller squares.

* * * * *